United States Patent [19]

Kajimoto et al.

[11] 3,973,485

[45] Aug. 10, 1976

[54] PLURAL LINE IMPRINTER FOR GAS CYLINDERS

[75] Inventors: Isamu Kajimoto, Amagasaki; Hideaki Morii, Gifu, both of Japan

[73] Assignees: Morii Chokoku Co., Ltd., Gifu; Sumikin-Kiko Co., Ltd., Amagasaki, both of Japan

[22] Filed: Aug. 8, 1975

[21] Appl. No.: 603,226

[30] Foreign Application Priority Data

Aug. 19, 1974 Japan ..... 49-94762

[52] U.S. Cl. ..... 101/7; 101/37; 101/38 A; 101/40; 198/22 R

[51] Int. Cl.[2] ..... B41F 17/08

[58] Field of Search ..... 101/36, 37, 38 R, 38 A, 101/39, 40, 5, 6, 7, 407 R, 407 A; 198/22 R, 22 B, 25, 245, DIG. 8

[56] References Cited

UNITED STATES PATENTS

| | | | |
|---|---|---|---|
| 985,479 | 2/1911 | Waller | 101/38 A |
| 1,657,382 | 1/1928 | Felten | 101/38 A X |
| 2,189,637 | 2/1940 | Litchfield | 101/38 A |
| 2,635,532 | 4/1953 | Stewart | 101/40 |
| 2,635,533 | 4/1953 | Stewart | 101/40 |
| 2,799,220 | 7/1957 | Oscroft | 101/37 |
| 2,855,845 | 10/1958 | Feeney | 101/39 |
| 3,163,106 | 12/1964 | Failor | 101/6 |
| 3,362,520 | 1/1968 | Rudolph et al. | 101/39 X |
| 3,800,696 | 4/1974 | Goto et al. | 101/37 X |
| 3,811,522 | 5/1974 | Wolf et al. | 101/37 |

*Primary Examiner*—E. H. Eickholt
*Attorney, Agent, or Firm*—Frank J. Jordan

[57] ABSTRACT

An apparatus for automatically imprinting several lines of characters on the rounded head of each steel or like metal cylinder for a compressed gas. The apparatus includes work rest means arranged between loading and unloading platforms and adapted to permit a gas cylinder which has been transferred from the loading platform to rest horizontally thereon so as to be rotatable about its own axis. Several marking mechanisms movable relative to the work rest means each include an arcuate marking surface on which a line of characters is formed in relief. The marking surface of each mechanism is successively forced into contact with the gas cylinder on the work rest means, and the marking mechanism is then rotated in rolling contact with the gas cylinder to imprint the line of characters thereon. The gas cylinder that has been marked with the desired lines of characters is transferred onto the unloading platform.

6 Claims, 5 Drawing Figures

A
B
C
79
64
66
65
58
56
44
43
43
30
17
41
41
28
12
59
29
10
28
W
W
59
46
45
42
28
30
18
42
45
52
W
W
W
55
34
40
56
57
31
51
39
50

PLURAL LINE IMPRINTER FOR GAS CYLINDERS

BACKGROUND OF THE INVENTION

This invention relates to an apparatus for automatically imprinting markings on the so-called bombs, or steel or like metal cylinders for compressed gases, among other metal-made cylindrical articles. More specifically, the invention deals with such marking apparatus capable of imprinting several lines of characters in a predetermined position on each gas cylinder or the like.

As is wll known, steel cylinders are widely used as containers for compressed gases such as those of oxygen, chlorine, hydrogen, and carbon dioxide. Such steel cylinders are required to be clearly engraved or imprinted with markings giving such information as the contents, date of production, serial number, and name of the manufacturer. This marking operation has heretofore been the handiwork of highly skilled artizans, performed at the expense of substantial time and labor because the information must be impressed on rounded surfaces of hard material. Moreover, as an inevitable result of manual operation, the characters impressed tend to be of irregular arrangement and uneven depth.

SUMMARY OF THE INVENTION

In view of the above outlined state of the art it is an object of this invention to provide an apparatus for imprinting markings on articles such as steel cylinders for compressed gases, which is easy to automate to such an extent as to require supervision only by unskilled labor.

Another object of the invention is to provide a marking apparatus of the character defined, which is well adapted to imprint several lines of characters on each article, although it is also employable to form a single line of characters on each article without any modification of its existing parts or components.

A further object of the invention is to provide a marking apparatus such that desired characters can be impressed on each article to an unvarying depth and in regular arrangement.

A still further object of the invention is to provide a marking apparatus which is well adapted to handle articles of various sizes.

With all these and other objects in view this invention provides, in brief, a marking apparatus which includes work rest means arranged between loading and unloading platforms and adapted to permit each article which has been transferred from the loading platform by first work transfer means to rest horizontally thereon so as to be rotatable about its own axis. The work rest means is provided with work holding means for releasably holding each article in position thereon against displacement during marking operation while permitting the article to rotate about its own axis. The apparatus further comprises a plurality of rotatable marking mechanisms each including an arcuate marking surface which has formed thereon a line of characters to be imprinted on each article.

For imprinting several lines of markings on the article rotatably supported in position on the work rest means, the marking mechanisms are successively moved to a predetermined marking position where the axis of rotation of each marking mechanism is in vertical register with the axis of the article on the work rest means. Each marking mechanism which has been moved to the marking position is then moved toward the article on the work rest means to force the marking surface thereof into pressure contact with the article. Each marking mechanism thus moves from the marking position in a direction perpendicular to a plane tangent to the article on the work rest means at its predetermined different point of contact with the marking surface. While the marking surface is held in pressure contact with the article, the marking mechanism is further rotated in rolling contact with the article to imprint a line of characters thereon. By the repetition of this procedure several lines of characters are imprinted on the article, and the marked article is then transferred from the work rest means onto the unloading platform by second work transfer means.

It should be noted that the desired characters are imprinted on each article while the successive marking mechanisms are in rolling contact therewith. There is accordingly no possibility of the work being damaged by application of any impulsive force or shock during the marking operation.

The features which are believed to be novel and characteristic of this invention are set forth in particular in the appended claims. The invention itself, however, both as to its organization and mode of operation, together with the further objects and advantages thereof, will become apparent in the course of the following description, which is to be read in connection with the accompanying drawings in which like reference characters denote corresponding parts of the several views.

DESCRIPTION OF THE PREFERRED EMBODIMENT

Figure 1:
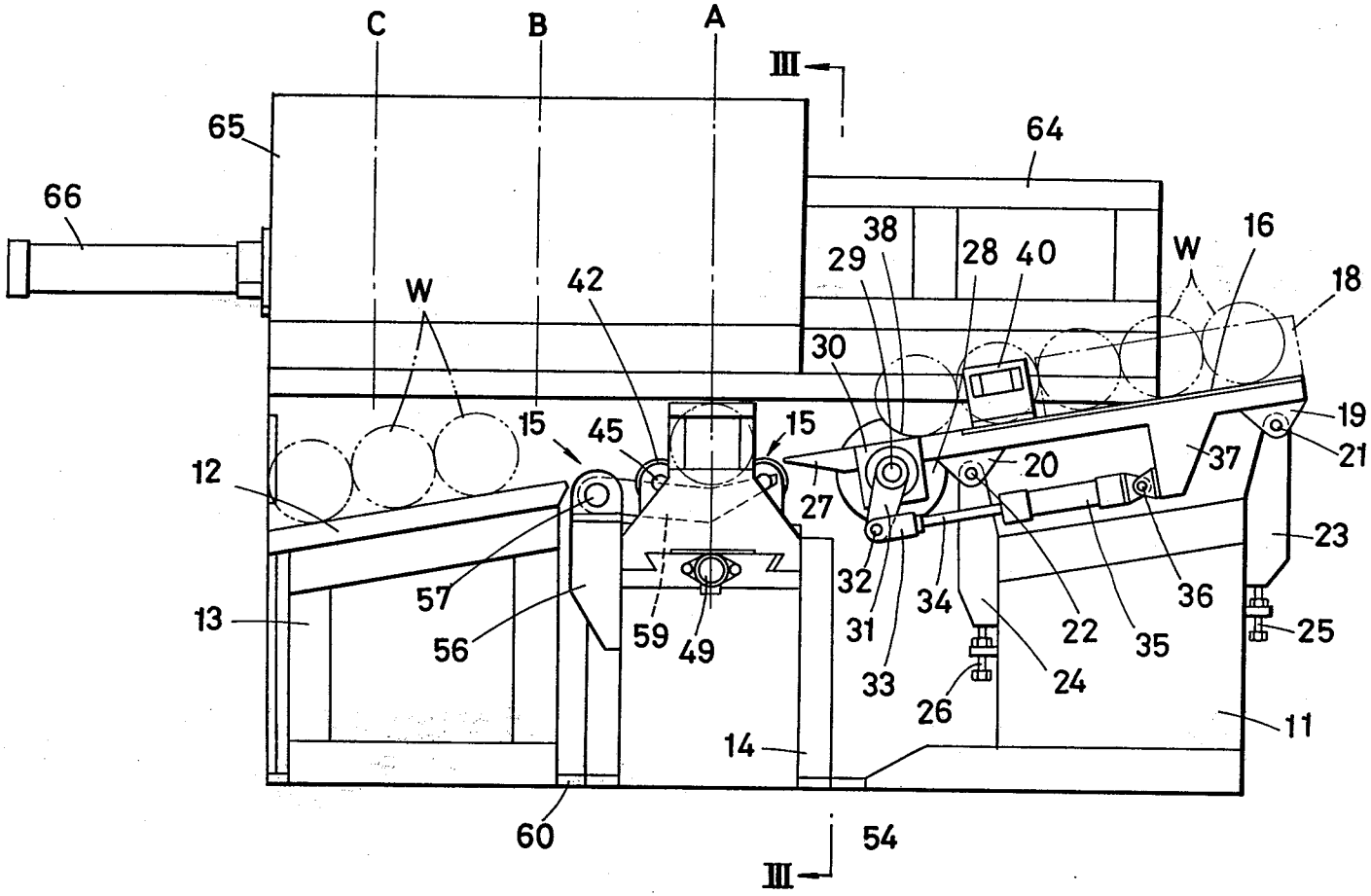
FIG. 1 is a side elevational view of the marking apparatus constructed in accordance with the novel concepts of this invention, the view not showing the marking mechanisms and some other related parts of the apparatus.
Figure 2:
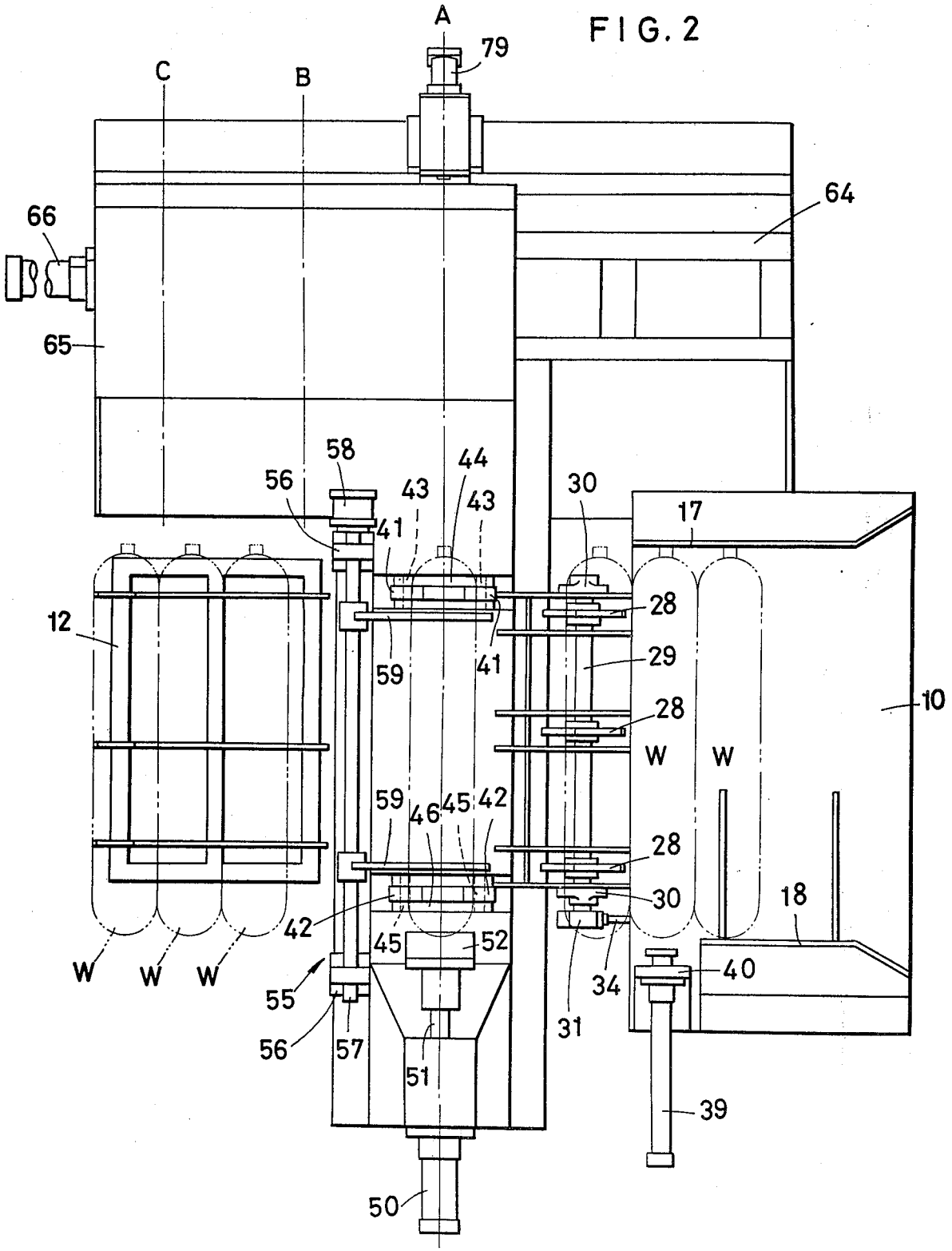
FIG. 2 is a top plan view of the marking apparatus shown in FIG. 1.

The invention is hereinafter described more specifically as adapted for an application where markings are to be imprinted in three parallel lines on the rounded head of each cylindrical vessel for a compressed gas (hereinafter referred to as a gas cylinder). With particular reference to FIGS. 1 and 2 the illustrated marking apparatus includes a loading platform 10 supported on a standard 11 at the rearward end of the apparatus, and an unloading platform 12 on a standard 13 at its forward end. Another standard 14 is arranged intermediate the aforesaid standards 11 and 13 to support thereon work rest means generally designated 15 in FIG. 1.

The loading platform 10 has a top surface 16 which declines forwardly and over which successive gas cylinders W are to roll toward the work rest means 15 as guided by a pair of opposed guide walls 17 and 18 formed thereon. A pair of lugs 19 project downwardly from the rearward end of the loading platform 10, and another similar pair of lugs 20 from the forward end of the loading platform. These pairs of lugs 19 and 20 are pinned at 21 and 22 to slides 23 and 24, respectively, that are slidably mounted on the standard 11 for up-and-down motion relative to the same. Adjusting screws 25 and 26 are provided to the respective slides 23 and 24 to cause their up-and-down motion on the standard 11. By the turn of these adjusting screws 25 and 26, therefore, the angular position of the loading platform 20 is variable as required with respect to the plane of the horizon.

The loading platform 10 terminates at its forward end in a plurality of prongs 27 that constitute a substantial extension of the declining top surface 16. In this particular adaptation of the invention the loading platform is shown to have three pairs of such prongs 27. Arranged between each prong pair is a stop disc 28 which is fixedly mounted on a shaft 29 for simultaneous rotation therewith. This shaft is rotatably journaled at both ends in a pair of bearing members 30 carried by the outermost ones of the prongs 27. One end of the shaft 29 projects out of the corresponding bearing member 30, and a crank arm 31 is fixedly mounted at one end on the projecting end of the shaft. The other end of the crank arm 31 is pivotally pinned at 32 to a member 33 on the tip of the piston rod 34 of a conventional cylinder actuator 35. This cylinder actuator is pivotally supported at 36 on a downward projection 37 from the loading platform 10.

The stop discs 28 partly project upwardly of the prongs 27, and arcuate indentations 38 are formed on the circumferences of the respective stop discs in angular registration with each other. As will be best understood from a consideration of FIG. 1, the indentations 38 are intended to receive the leading one of the gas cylinders W held standing by on the loading platform 10 when the piston rod 34 of the cylinder actuator 35 is in its extended position as in the drawing, thereby preventing the gas cylinders from rolling forwardly over the loading platform by gravity. Upon retraction of the piston rod 34 the stop discs 28 will rotate counterclockwise, as viewed in FIG. 1, to permit the leading gas cylinder to travel on to work rest means 15. In this manner the stop discs 28 together with the cylinder actuator 35 and so forth serve also as a work transfer mechanism for supplying the gas cylinders W to the work rest means 15 one by one.

While the leading gas cylinder is being transferred as above from the loading platform 10 onto the work rest means 15, the other gas cylinders on the platform must be restrained from traveling forwardly. To this end the guide wall 18 on the loading platform 10 is made shorter than the other guide wall 17, and another cylinder actuator 39 is supported by its mount arranged at 40 on the loading platform 10. Upon extension of the piston rod of this cylinder actuator 39 the gas cylinder positioned next to the leading one on the platform will be caught between the piston rod and the guide wall 17, with the result that all but the leading one of the gas cylinders are locked against forward travel over the platform.

Figure 3:
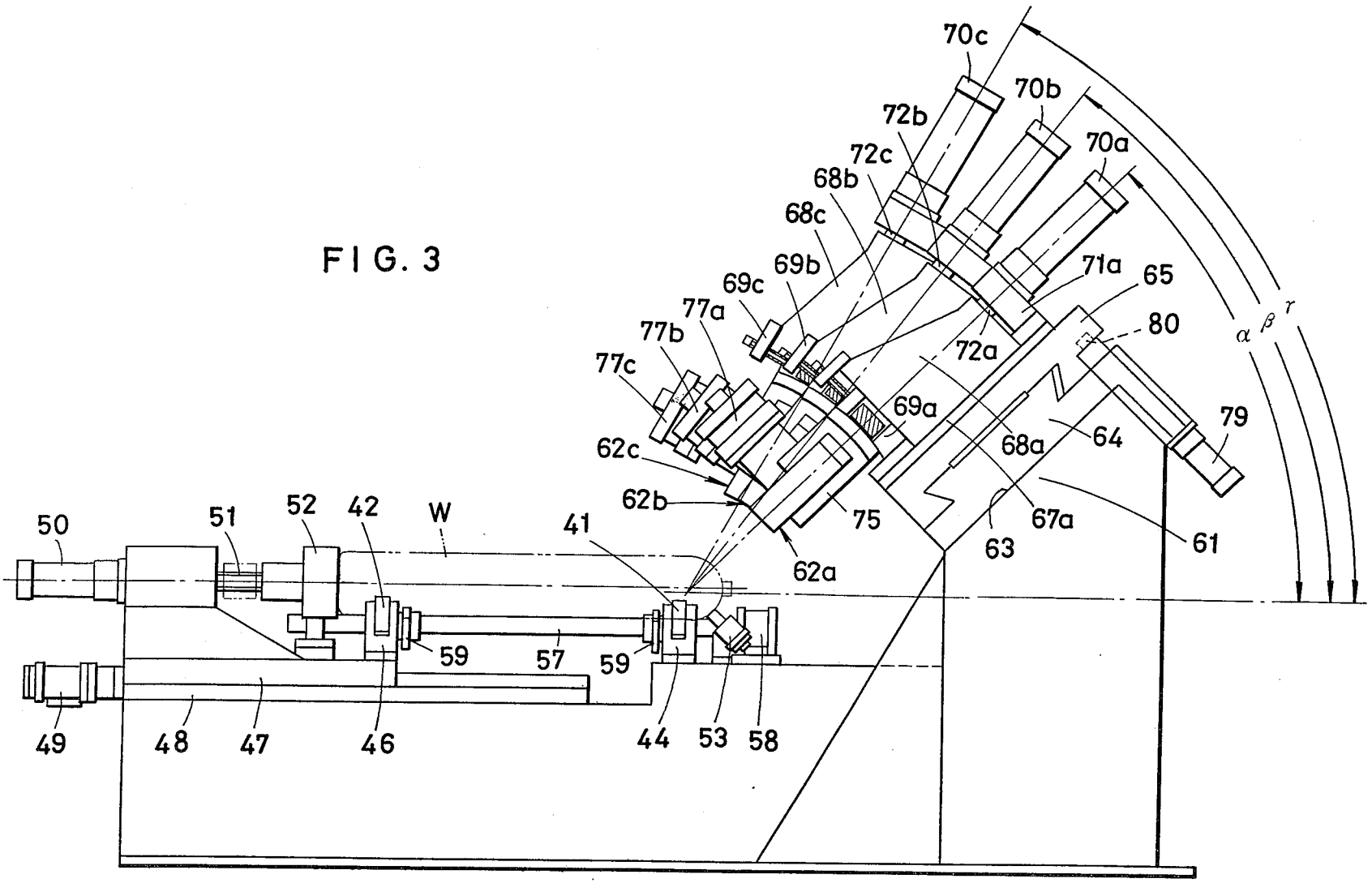
FIG. 3 is a vertical sectional view taken substantially along the plane of line III—III in FIG. 1.

With reference to FIGS. 1, 2 and 3 the aforesaid work rest means 15 includes transversely spaced pairs of rolls 41 and 42 adapted to permit the successive gas cylinders W from the loading platform 10 to rest horizontally thereon so as to be rotatable about their own axes. The pair of rolls 41 are rotatably mounted in parallel spaced relationship on respective shafts 43 that are supported by a support 44 on the standard 14. Preferably, these rolls 41 should be made equidistantly movable toward and away from each other to permit adjustment of the height of the work mounted thereon.

The other pair of rolls 42 are likewise rotatably mounted in parallel spaced relationship on respective shafts 45 supported by a support 46. These rolls should also be equidistantly movable toward and away from each other to permit adjustment of the work height. The support 46 is fixedly mounted on a carriage 47, FIG. 3, that is slidable over a guideway 48 extending toward the other support 44. The roll pair 42 is therefore movable toward and away from the other roll pair 41 to adjust to the axial length of each gas cylinder W to rest thereon. For thus moving the roll pair 42 a suitable actuator such as a hydraulic motor of conventional make is provided at 49 to cause the back-and-forth motion of the carriage 47 along the guideway 48.

Also mounted on the carriage 47 is a cylinder actuator 50 which is so arranged as to be substantially in axial alignment with the gas cylinder W on the work rest means 15. This cylinder actuator has a piston rod 51 on the tip of which there is mounted a rotatable fitting 52 of suitable configuration for abutting contact with the bottom of the gas cylinder on the work rest means 15. In the operation of this marking apparatus each gas cylinder which has been transferred onto the work rest means 15 from the loading platform 10 will be fed a suitable distance toward the right, as viewed in FIG. 3, by the cylinder actuator 50 in order that the gas cylinder may lie in a predetermined position on the work rest means with respect to the transverse direction of the apparatus, ready for the subsequent marking operation.

As shown in FIG. 3, a proximity switch 53 of conventional design is arranged adjacent the roll pair 41 so as to underlie the rounded head of the gas cylinder W supported in position on the work rest means 15. The proximity switch 53 will be actuated when approached by the gas cylinder W on the work rest means 15, the gas cylinder being so moved by the cylinder actuator 50. Although the electrical details are not illustrated because of their common and well known nature, it is assumed that the proximity switch 53 when actuated cuts off the operation of the cylinder actuator 50, as later described in greater detail.

It will be observed from FIG. 1 that the work rest means 15 is so arranged relative to the loading platform 10 that the tips of the prongs 27 projecting forwardly from the loading platform lie sufficiently close to the tops of the right hand ones, as seen in the drawing, of the rolls 41 and 42. This arrangement is essential for smooth transfer of the successive gas cylinders W from the loading platform 10 onto the work rest means 15. Connectors 54 rigidly interconnect the standards 11 and 14 to hold the loading platform and work rest means in the desired relative positions.

The reference numeral 55 in FIGS. 1 and 2 generally represents a second work transfer mechanism for transfer of the successive gas cylinders that have been marked on the work rest means 15 onto the unloading platform 12. The second work transfer mechanism 55 includes a pair of brackets 56 fixedly mounted on the forward end of the standard 14 for the work rest means 15. A shaft 57 is rotatably journaled at both ends in the brackets 56 and is coupled to the output shaft of a conventional rotary actuator fixedly mounted at 58. A pair of work transfer arms 59 extend rearwardly from the shaft 57 so as to be located internally of the supports 44 and 46 of the work rest means 15 at slight spacings therefrom. The work transfer arms 59 are normally held under the gas cylinder W on the work rest means 15 and, upon operation of the rotary actuator 58, will swing counterclockwise, as viewed in FIG. 1, about the shaft 57 to cause the work to roll over the same onto the unloading platform 12.

The unloading platform 12 also declines forwardly and has its rearward end arranged suitably close to the forward ends of the work transfer arms 59 for smooth transfer of the successive gas cylinders W from the work rest means 15. Connectors 60 rigidly interconnect the standards 13 and 14 to hold the unloading platform 12 in the desired position with respect to the second work transfer mechanism 55.

As will be seen from FIGS. 2 and 3 in particular, an additional standard 61 is arranged on one side of and along the path of travel of the gas cylinders W from the loading platform 10 to the unloading platform 12 for holding thereon three marking mechanisms 62*a*, 62*b* and 62*c* and various other parts and components associated therewith. The standard 61 has a sloping top 63 on which there is formed a guideway 64 extending the full length of the standard. A slide 65 slidably mounted on this guideway 64 is coupled to the piston rod of a cylinder actuator 66 fixedly supported at the left hand end, as seen in FIGS. 1 and 2, of the guideway.

The capitals A, B and C in FIGS. 1 and 2 represent notional lines extending transversely of the guideway 64 at constant spacings. The line A, aligned with the axis of the gas cylinder W supported in position on the work rest means 15, represents a position where the desired three lines of markings are to be successively imprinted on the gas cylinder by the marking mechanisms 62*a* to 62*c*. This line will therefore be hereinafter referred to as the marking line. The lines B and C represent the positions where, while the first marking mechanism 62*a* lies on the marking line A, the second and third marking mechanisms 62*b* and 62*c* are to be held standing by. The lines B and C will therefore be hereinafter referred to as the first and second standby lines, respectively.

With reference again to FIG. 3 the slide 65 has formed thereon a guideway 67*a* which extends at right angles with the mentioned guideway 64 and which declines toward the work rest means 15 at an angle of $\alpha$ degrees with respect to the plane of the horizon. This sloping guideway 67*a* is located on the marking line A when the slide 65 is on the left hand end of the guideway 64 as best shown in FIGS. 1 and 2. Slidably mounted on the sloping guideway 67*a* is a carriage 68*a* having the first marking mechanism 62*a* attached thereto via an angle adjustment mechanism 69*a*. A cylinder actuator 70*a* fixedly supported by a mount 71*a* on the guideway 67*a* has its piston rod 72*a* coupled to the carriage 68*a* to cause the reciprocating motion of the first marking mechanism 62*a* toward and away from the rounded head of the gas cylinder W on the work rest means 15.

Figure 4:
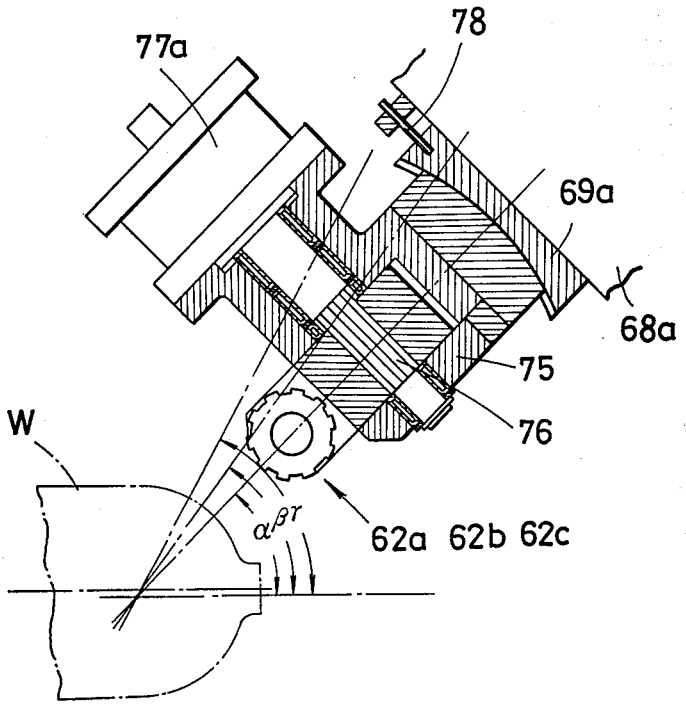
FIG. 4 is an enlarged, axial sectional view of one of the marking mechanisms and other related parts shown in FIG. 3, the view being also explanatory of the positional relations between the marking mechanisms and the work to be marked.
Figure 5:
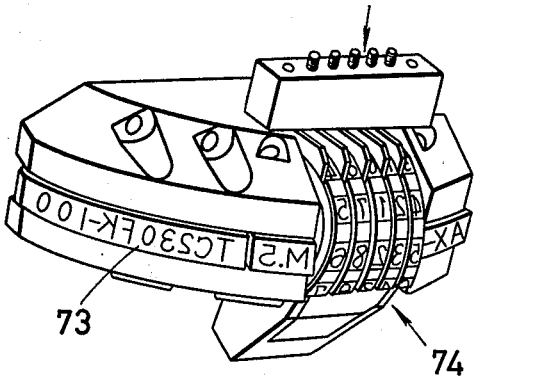
FIG. 5 is a perspective view of the marking mechanism shown in FIG. 4.

As illustrated in greater detail in FIGS. 4 and 5, the first marking mechanism 62*a* has an arcuate marking surface 73 that has formed thereon a line of suitable characters in relief. This marking surface is intended to make rolling contact with the head of each gas cylinder W rotatably supported on the work rest means 15 and hence to imprint the line of characters thereon. The marking mechanism may include a numbering mechanism 74 of known construction so that consecutive numbers may be marked on the successive gas cylinders along with the other necessary indicia.

The first marking mechanism 62*a* is rotatable through a predetermined angle relative to its holder 75 about a shaft 76 the axis of which is in vertical register with the marking line A when the slide 65 is on the left hand end of the guideway 64. A conventional rotary actuator 77*a* is mounted on the holder 65 to impart rotation to the shaft 76 and thence to the marking mechanism. The angular position of this marking mechanism, inclusive of its holder 75, with respect to the plane of the horizon is manually adjustable as required by an adjusting screw 78 constituting a part of the angle adjustment mechanism 69*a*.

It should be noted that the first marking mechanism 62*a* is moved back and forth by the cylinder actuator 70*a* in a direction perpendicular to the plane tangent to the gas cylinder W on the work rest means 15 at its predetermined point of contact with the marking surface 73. This direction, of course, is at the angle of $\alpha$ degrees with the plane of the horizon. The marking surface 73 of the first marking mechanism 62*a* may first be pressed against the work on the work rest means 15 by the cylinder actuator 70*a* and may then be rotated through the predetermined angle in rolling contact with the work by the rotary actuator 77*a*. After the complete line of characters has been impressed on the work, the marking mechanism may be rotated in the opposite direction back to its initial angular position by the rotary actuator 77*a*, with is marking surface still in rolling contact with the work. The cylinder actuator 70*a* is then re-activated to retract the marking mechanism and various other associated means to the position shown in FIG. 3.

Although not illustrated, two other guideways identical with the illustrated guideway 67*a* are assumed to be formed on the slide 65 in parallel relationship thereto. Arranged on these unshown guideways are, respectively, the second and third marking mechanisms 62*b* and 62*c*, carriages 68*b* and 68*c*, angle adjustment mechanisms 69*b* and 69*c*, cylinder actuators 70*b* and 70*c*, rotary actuators 77*b* and 77*c*, and so forth. The arrangement of the various parts on each of the two additional guideways, and the construction of each part, are exactly identical with those set forth above in connection with the illustrated guideway 67*a*.

The second and third marking mechanisms 62*b* and 62*c* are, of course, also rotatable relative to their own holders, and the axes of rotation of these marking mechanisms are in vertical register with the first and second standby lines B and C, respectively, when the slide 65 is on the left hand end of the guideway 64 as in FIGS. 1 and 2.

As shown in FIGS. 2 and 3, a further cylinder actuator 79 is mounted on the standard 61 with its axis in vertical register with the marking line A. The piston rod of this cylinder actuator, when extended, is intended to be releasably engaged in any of three positioning holes 80 that are formed in the slide 65 so as to be located on the marking and standby lines A, B and C, respectively, when the slide is on the left hand end of the guideway 64.

It is important to note that the aforesaid two unshown guideways are arranged at angles of $\beta$ and $\gamma$ degrees, respectively, with the plane of the horizon. Thus, when the second and third marking mechanisms 62*b* and 62*c* on these guideways are successively moved to the marking line A by the cylinder actuator 66, the marking mechanisms will respectively travel back and forth in directions perpendicular to the planes tangent to the gas cylinder W on the work rest means 15 at its predetermined different points of contact with the marking surfaces of the second and third marking mechanisms. The second and third marking mechanisms are thus adapted to imprint two additional lins of markings on the head of each gas cylinder as they successively travel to the marking line A.

Preparatory to the actual marking operation the various operating parts of this marking apparatus are in need of adjustment. The piston strokes of the cylinder actuators 66 and 79 should be so adjusted that the slide 65 will be successively fed along the guideway 64 a distance equal to the spacing between the marking and standby lines A, B and C and will be locked against displacement when any of the three marking mechanisms 62*a* to 62*c* is positioned on the marking line A.

The hydraulic motor 49 may be actuated to move the carriage 47 to a suitable position on the guideway 48 in accordance with the axial length of each gas cylinder to be marked. The spacing between the roll pairs 41 and 42 of the work rest means 15 is thus adjustable to the length of the gas cylinder to rest thereon. The position of the cylinder actuator 50 on the carriage 47 is of course adjusted simultaneously with the adjustment of the spacing between the roll pairs 41 and 42.

The spacing between the pair of rolls 41, and that between the other pair of rolls 42, should be correspondingly adjusted so that the gas cylinder mounted thereon will be in axial alignment with the cylinder actuator 50. Attention should also be paid to the proximity switch 53, which must be actuated to terminate the extension of the piston rod 51 of the cylinder actuator 50 at the exact moment the gas cylinder is moved to the predetermined position on the work rest means 15 with respect to the transverse direction of the apparatus.

The angular positions of the three marking mechanisms 62*a* to 62*c* with respect to the plane of the horizon may be adjusted, if necessary, by the respective angle adjustment mechanisms 69*a* to 69*c* so that the arcuate marking surfaces 73 of the marking mechanisms will make close rolling contact exactly with the desired portions of the gas cylinder rotatably supported in position on the work rest means 15. The piston strokes of the cylinder actuators 70*a* to 70*c* should be such that the surfaces 73 of the three marking mechanisms will be forced against the gas cylinder on the work rest means 15 to a sufficient degree to imprint the desired markings thereon.

Upon completion of these preadjustments the piston rod 34 of the cylinder actuator 35 under the loading platform 10 should be extended to make the arcuate indentations 38 on the stop discs 28 ready for receiving the leading one of the gas cylinders to be placed upon the loading platform. The piston rods of all the other cylinder actuators should be retracted. If all the actuators used in this marking apparatus are of the type operated hydraulically, then a source of hydraulic pressure (not shown) to which the actuators are connected through suitable piping and valving may now be switched on to make them ready for operation at desired working pressures.

Gas cylinders W to be marked may then be loaded successively on the loading platform 10 at its rearward end, with the rounded heads of the cylinders directed away from the viewer as seen in FIG. 1. The loaded gas cylinders will roll forwardly over the declining top surface 16 of the platform as guided by the opposed guide walls 17 and 18 until the leading gas cylinder stops upon engagement in the arcuate indentations 38 on the stop discs 28. The several gas cylinders that have been deposited on the loading platform are then held at a temporary standstill thereon in close side-by-side relationship. The cylinder actuator 39 on the loading platform is then activated to cause extension of its piston rod and hence to engage the second gas cylinder between this piston rod and the guide wall 17.

While all but the leading one of the gas cylinders on the loading platform 10 are thus restrained from traveling forwardly thereover, the piston rod 34 of the cylinder actuator 35 may be retracted to cause the stop discs 28 to rotate counterclockwise, as viewed in FIG. 1, via the crank arm 31 and shaft 29. The leading gas cylinder will then move over the stop discs 28 and, after further rolling over the prongs 27, will be transferred onto the work rest means 15.

The cylinder actuator 50 on the carriage 47 may then be activated to cause extension of its piston rod 51 so that the rotatable fitting 52 on its tip will move into abutting contact with the bottom of the leading gas cylinder. The piston rod 51 further extends to cause the gas cylinder to slide over the roll pairs 41 and 42 until the gas cylinder actuates the proximity switch 53. With the cylinder actuator 50 resultantly set out of operation, the leading gas cylinder is now rotatably supported in position on the work rest means 15, free from any possibility of displacement during the subsequent marking operation.

The cylinder actuator 70*a* for the first marking mechanism 62*a* is then activated to cause the carriage 68*a*, and therefore the first marking mechanism 62*a*, to travel downwardly along the sloping guideway 67*a*. The arcuate marking surface 73 of the first marking mechanism is thus forced into pressure contact with the rounded head of the leading gas cylinder on the work rest means 15. As the rotary actuator 77*a* is succeedingly set in operation, the first marking mechanism will rotate through the predetermined angle with its marking surface 73 in rolling contact with the gas cylinder.

With the desired characters thus imprinted in a single line on the head of the leading gas cylinder W on the work rest means 15, the direction of rotation of the rotary actuator 77*a* is reversed to bring the first marking mechanism 62*a* and gas cylinder back to their initial angular positions. By then causing retraction of the piston rod 72*a* of the cylinder actuator 70*a*, the first marking mechanism 62*a* will travel back to the position of FIG. 3 along with the carriage 68*a* and various other associated parts.

The cylinder actuator 79 is succeedingly activated to cause retraction of its piston rod that has been releasably engaged in the positioning hole 80 formed in the slide 65 just under the cylinder actuator 70*a* for the first marking mechanism 62*a*. The cylinder actuator 66 is then activated to cause the slide 65 to travel along the guideway 64 toward the right, as seen in FIGS. 1 and 2, a distance equal to the spacing between the lines A, B and C. The piston rod of the cylinder actuator 79 is again extended and is releasably engaged in the positioning hole 80 for the second marking mechanism 62*b*.

The second marking mechanism 62*b*, thus transferred from the first standby line B to the marking line A together with the various means associated therewith, is now ready for imprinting the second line of characters on the head of the leading gas cylinder W on the work rest means 15 by the repetition of the foregoing procedure. Thereafter the third marking mechanism 62*c* is similarly transferred to the marking line A to imprint the third line of characters on the work.

Upon completion of the marking operation on the leading gas cylinder the cylinder actuator 66 is activated to cause complete retraction of its piston rod and hence to cause the slide 65 to travel back to the initial position of FIGS. 1 and 2. In the meantime the rotary actuator 58 of the second work transfer mechanism 55 is set in operation to cause the pair of work transfer arms 59 to swing counterclockwise, as viewed in FIG. 1, about the shaft 57. The marked leading gas cylinder will then roll onto the unloading platform 12.

Simultaneously, the piston rod 34 of the cylinder actuator 35 under the loading platform 10 is extended to make the stop discs 28 ready for engaging the second gas cylinder in their arcuate indentations 38. Marking operation on this second gas cylinder can be initiated as the cylinder actuator 39 succeedingly releases the same by retraction of its piston rod.

The foregoing cycle is repeated to imprint the three lines of markings on each of the successive gas cylinders. It will have been understood that the marking apparatus according to this invention lends itself to easy automation.

While a preferred form of the marking apparatus according to this invention has been shown and described, it is understood that changes may be made in the constructional details disclosed, without departing from the spirit and scope of the invention as sought to be defined in the following claims.

What is claimed is:

1. An apparatus for imprinting a plurality of lines of markings on each of articles such as steel cylinders for compressed gases, comprising in combination:

a. a loading platform;

b. an unloading platform;

c. work rest means between said loading and unloading platforms, said work rest means being adapted to permit each article to rest horizontally thereon so as to be rotatable about its own axis;

d. first work transfer means for transfer of the articles from said loading platform onto said work rest means one by one;

e. work holding means for releasably holding each article in position on said work rest means against displacement during marking operation while permitting the article to rotate about its own axis;

f. a plurality of marking mechanisms movable relative to said work rest means, each marking mechanism having an axis of rotation and including an arcuate marking surface which has formed thereon a line of characters to be imprinted on each article;

g. first actuator means for successively moving said marking mechanisms to a predetermined marking position where said axis of rotation of each said marking mechanism is in vertical register with the axis of the article held in position on said work rest means;

h. second actuator means for moving each said marking mechanism which has been moved to said marking position back and forth to bring said marking surface thereof into and out of pressure contact with the article on said work rest means, each said marking mechanism being thus moved in a direction perpendicular to a plane tangent to the article on said work rest means at its predetermined different point of contact with said marking surface;

i. means for rotating each said marking mechanism about said axis of rotation thereof while said marking surface thereof is in pressure contact with the article on said work rest means whereby the marking mechanism makes rolling contact with the article to imprint the line of characters thereon; and j. second work transfer means for transfer of the marked article from said work rest means onto said unloading platform.

2. The apparatus as recited in claim 1, wherein said loading platform declines forwardly to permit the articles placed thereon to roll toward said work rest means by gravity, and wherein said first work transfer means comprises:

a. plurality of stop members supported adjacent the forward end of said loading platform for joint movement relative to the same, said stop members being spaced from each other in the transverse direction of said loading platform; and b. means for causing said stop members to move relative to said loading platform between a first position where they prevent the articles from rolling forwardly and a second position where they permit the leading one of the articles to travel toward said work rest means.

3. The apparatus as recited in claim 2, including means for holding all but the leading one of the articles on said loading platform at a temporary standstill thereon when said stop members are moved to said second position.

4. The apparatus as recited in claim 1, further comprising:

a. a first guideway extending along the path of travel of the articles from said loading to said unloading platform via said work rest means;

b. a slide movable back and forth along said first guideway, said slide being moved along said first guideway by said first actuator means;

c. a plurality of second guideways formed on said slide, said second guideways extending at right angles with said first guideway and being arranged at constant spacings from each other; and d. a plurality of carriages movable back and forth along said second guideways respectively, each carriage rotatably supporting one of said marking mechanisms thereon and being moved along one of said second guideways by said second actuator means.

5. The apparatus as recited in claim 4, including positioning means for releasably locking said slide against movement along said first guideway at the exact positions where the axes of rotation of said marking mechanisms are in vertical register with the axis of the article held in position on said work rest means.

6. The apparatus as recited in claim 1, wherein said second work transfer means comprises:

a. at least a pair of arms supported adjacent the forward end of said work rest means so as to be swingable about a common axis, said arms being normally held under the article on said work rest means; and b. means for causing said arms to swing upwardly to such an extent that the article will roll thereover onto said unloading platform.

* * * * *